US006565411B1

(12) United States Patent
Fosbenner et al.

(10) Patent No.: US 6,565,411 B1
(45) Date of Patent: May 20, 2003

(54) KEY ACTIVATED TOY VEHICLE

(75) Inventors: Mary Ellen Gertrude Fosbenner, Riverton, NJ (US); Robert Jude Henry, Riverside, NJ (US); Matthew Felix Agostini, Philadelphia, PA (US); William Francis Michael Dougherty, Oakford, PA (US); Gregory John Sisolak, Mt. Laurel, NJ (US)

(73) Assignee: Mattel, Inc., El Sequndo, CA (US)

( * ) Notice: Subject to any disclaimer, the term of this patent is extended or adjusted under 35 U.S.C. 154(b) by 0 days.

(21) Appl. No.: 10/161,209

(22) Filed: May 31, 2002

(51) Int. Cl.[7] ..... A63H 29/24
(52) U.S. Cl. ..... 446/464; 446/486
(58) Field of Search ..... 446/457, 464, 446/465, 486, 437

(56) References Cited

U.S. PATENT DOCUMENTS

| | | | | |
|---|---|---|---|---|
| 2,594,527 | A | | 4/1952 | Wechsler |
| 2,607,163 | A | | 8/1952 | Lohr |
| 4,219,962 | A | | 9/1980 | Dankman et al. |
| 4,345,402 | A | | 8/1982 | Hanson et al. |
| 4,411,098 | A | | 10/1983 | Birdsall et al. |
| 4,418,495 | A | | 12/1983 | Kennedy et al. |
| 4,424,978 | A | | 1/1984 | Kassai |
| 4,425,735 | A | | 1/1984 | Kulesza et al. |
| 4,443,966 | A | | 4/1984 | Birdsall |
| 4,565,537 | A | | 1/1986 | Klimpert et al. |
| 4,690,654 | A | | 9/1987 | DeLaney |
| 4,717,366 | A | | 1/1988 | Ishimoto |
| 4,737,135 | A | | 4/1988 | Johnson et al. |
| 4,764,149 | A | * | 8/1988 | Yoneyama ..... 446/440 |
| 4,925,427 | A | | 5/1990 | Wu |
| 4,969,851 | A | | 11/1990 | Rasmussen |
| 4,976,650 | A | | 12/1990 | Watanabe |
| 5,022,884 | A | | 6/1991 | Hippely et al. |
| 5,069,649 | A | | 12/1991 | Wu |
| 5,141,467 | A | | 8/1992 | Crosbie |
| 5,674,105 | A | | 10/1997 | Hamlin |
| 5,791,967 | A | | 8/1998 | Yeh |
| 5,807,158 | A | | 9/1998 | Tsai |
| 5,916,007 | A | * | 6/1999 | Maxim ..... 446/130 |

* cited by examiner

*Primary Examiner*—Jacob K. Ackun
(74) *Attorney, Agent, or Firm*—Akin Gump Strauss Hauer & Feld, L.L.P.

(57) ABSTRACT

A key activated toy vehicle includes a body having a front end, a rear end and an exterior. The toy vehicle also includes a chassis that accommodates the body. At least one of the body and the chassis defines an opening to an interior of the toy vehicle. The toy vehicle includes a spring supported within the vehicle so as to be compressed by a key inserted through the opening and to propel the toy vehicle away from the key upon decompressing. The toy vehicle includes a moveable part being supported on one of the chassis and the body for movement between a first position and a second position. The toy vehicle includes an actuator mechanism operably coupled with the spring and moveably mounted within the vehicle so as to be coupled with the moveable part to move the part from the first position to the second position.

15 Claims, 8 Drawing Sheets

KEY ACTIVATED TOY VEHICLE

BACKGROUND OF THE INVENTION

The present invention relates generally to key activated toy vehicles and, more particularly, to a key activated spring propelled toy vehicle.

Spring actuated toy vehicles are fairly well known in the art. Some previously disclosed spring actuated toy vehicles have a spring mounted internally to the vehicle coupled to a hammer or a plunger. The spring and hammer are capable of being compressed by either an external "key" or by a handle or lever partially exposed on the exterior of the toy vehicle. A release mechanism on the key or on the toy vehicle allows the spring and hammer to extend rapidly within the vehicle thereby propelling the vehicle in at least one direction.

In another, more complex version of spring actuated toy vehicles, the toy vehicle further includes a base or launching pad where the spring and the hammer are mounted within the base. The toy vehicle is pushed into the base so as to rest against the hammer with the spring in the compressed position. A release mechanism on the base allows the spring and hammer to extend rapidly pushing the toy vehicle and propelling the toy vehicle forward.

In yet another, even more complex version of a spring actuated toy vehicle, the toy vehicle has a spring mounted internally to the vehicle coupled to a hammer and is used in combination with a base having a launching lever to release the toy vehicle and subsequently the hammer and spring to thereby propel the toy vehicle forward.

Other toy vehicles that are not spring actuated are propelled by conventional electrical motors include figurines that are moved by a system of levers, gears and cams to simulate action by the figurines. The gears are in mesh with take-off gears from the drive motor to provide the power for movement.

What is not provided by the previously disclosed spring actuated toy vehicles and toy vehicles with moving figurines is a toy vehicle that moves or actuates a moveable part of the vehicle in addition to propelling the vehicle from a common spring biased mechanism.

BRIEF SUMMARY OF THE INVENTION

Briefly stated, in one aspect of the present invention is a key activated toy vehicle. The toy vehicle comprises a body having a front end, a rear end and an exterior. The toy vehicle also comprises a chassis that accommodates the body and has at least a front wheel proximate the front end and a rear wheel proximate the rear end. At least one of the body and the chassis defines an opening to an interior of the toy vehicle. The toy vehicle also includes a spring supported within the vehicle so as to be compressed by a key inserted through the opening and to propel the toy vehicle away from the key upon decompressing. The toy vehicle also includes a moveable part having at least a portion on the exterior of the body and being supported on at least one of the chassis and the body for movement between a first position and a second position. The toy vehicle further includes an actuator mechanism operably coupled with the spring and moveably mounted within the vehicle so as to be coupled with the moveable part so as to move the part from the first position to the second position as the actuator mechanism moves against the bias of the spring.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
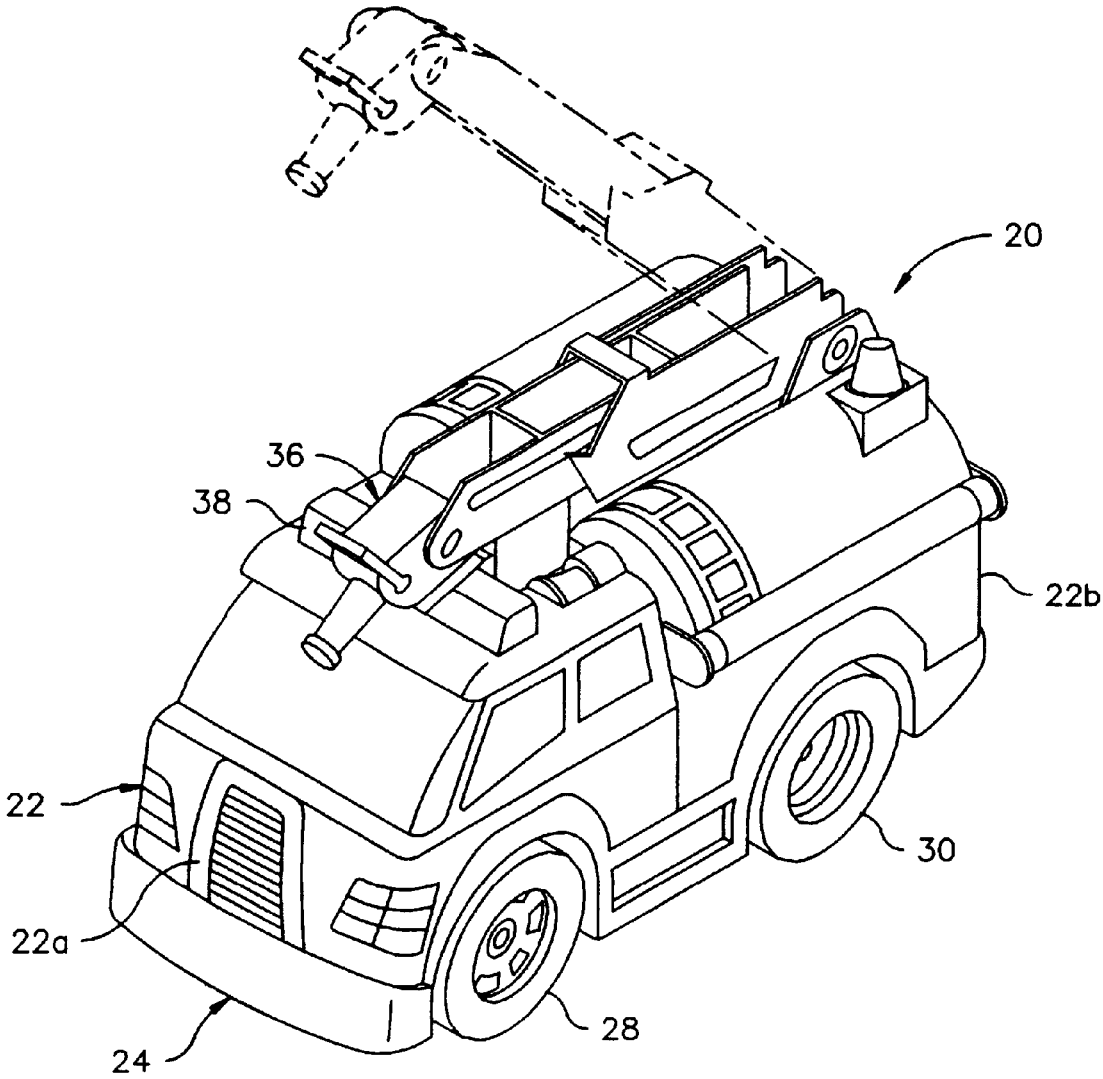
FIG. 1 is a perspective view of a key activated toy vehicle in accordance with a first preferred embodiment of the present invention.

Certain terminology is used in the following description for convenience only and is not limiting. The words "right," "left," "lower" and "upper" designate directions in the drawings to which reference is made. The words "inwardly" and "outwardly" refer to directions toward and away from respectively, the geometric center of the device discussed and designated parts thereof. The terminology includes the words above specifically mentioned, derivatives thereof and words of similar import. Additionally, the word "a" as used in the claims and in the corresponding portions of the specification, means "one or more than one."

Figure 2:
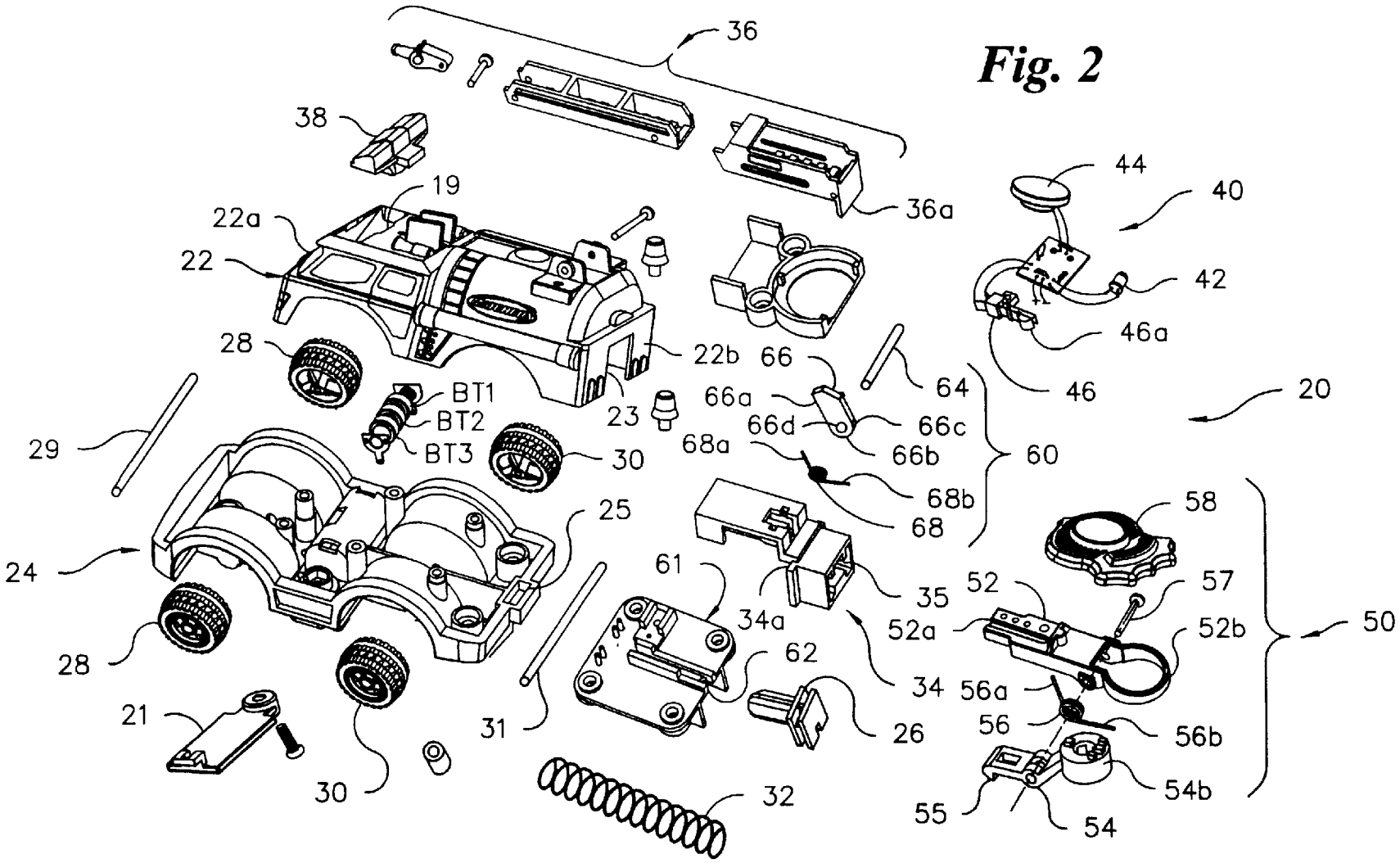
FIG. 2 is an exploded view of the toy vehicle of FIG. 1.

In the drawings, like numerals are used to indicate like elements throughout. Referring to the drawings in detail, there is shown in FIGS. 1–2 a key activated toy vehicle 20 in accordance with a first preferred embodiment of the present invention. Preferably, the key activated toy vehicle 20 has the overall appearance of either a fire rig, a fire truck, an ambulance, a rescue vehicle, a K-9 wagon, a police car, an emergency vehicle, a tow truck, a sport utility vehicle, an off-road vehicle, a boat, a hovercraft, a search light vehicle, or the like. But, the key activated toy vehicle 20 may have other overall appearances without departing from the present invention. As shown in FIGS. 1–2, the presently preferred embodiment has the overall appearance of a fire truck with a moveable part in the form of a ladder.

The key activated toy vehicle 20 that is propelled utilizing a key includes a body 22, a chassis 24 and a plunger 26 supported in one of the chassis 24 and the body 22. The body 22 has a front end 22*a* and a rear end 22*b*. The chassis 24 accommodates the body 22 and has at least a front wheel 28 proximate the front end 22*a* of the body 22 and a rear wheel 30 proximate the rear end 22*b* of the body 22. Preferably, the key activated toy vehicle 20 has two front wheels 28 and two rear wheels 30 moveably mounted on axles 29 and 31, respectively. At least one of the body 22 and the chassis 24 defines an opening 23 to an interior of the key activated toy vehicle 20. Preferably, the body 22 defines the opening 23. A spring 32 is supported within the key activated toy vehicle 20 so as to be compressed by a key 50 inserted through the opening 23 and to propel the toy vehicle 20 away from the key upon decompressing. Preferably, the spring 32 is operably coupled with the plunger 26 and biases the plunger 26 toward the rear end 22*b* of the body 22. The key activated toy vehicle also includes a moveable part 36 in the form of a ladder having at least a portion 36*a* interior to the body 22 and a portion (the remainder) exterior to the body 22. The moveable part 36 is supported on at least one of the chassis 24 and the body 22, in this case the body 22, for movement between a first position and a second position. Alternatively, the moveable part 36 may be a door, a window, a tow boom, a boom light, a propeller, a vehicle cab, a trunk lid, a water cannon, fans and the like without departing from the invention. The key activated toy vehicle 20 further includes an actuator mechanism 60 operably coupled with the spring 32 and moveably mounted within the toy vehicle 20 so as to be coupled with the moveable part 36 to move the part 36 from the first position to the second position as the actuator mechanism 60 moves against the bias of the spring 32.

Referring to FIG. 2 in detail, the actuator mechanism 60 includes a key receiver 34 that is moveably mounted to one of the body 22 and the chassis 24. Preferably, the key receiver 34 is mounted in the body 22 at the rear end 22*b* of the body 22 and extends at least partially through the opening 23. The key receiver 34 defines at least part of a key slot 35 and is biased rearwardly by the spring 32. The key receiver 34 rides on a base support 61 with an elongate channel guide 62 formed in the base support 61. The mechanism 60 also includes a pivot pin 64, an upwardly extending arm 66, and a torsion spring 68. The elongate channel guide 62 extends from an end 34*a* of the key receiver 34 and defines at least part of the key slot 35. The pivot pin 64 is moveably mounted within the actuator mechanism 60. The upwardly extending arm 66 has an upper, contact end 66*a,* a lower, pivot end 66*b,* a spring slot 66*c* and a pin hole 66*d* to receive the pivot pin 64 at the pivot end 66*b*. The torsion spring 68 has a first end 68*a* in the spring slot 66*c* of the arm 66 and a second end 68*b* resting on an upper surface of the key receiver 34. The torsion spring 68 biases the arm 66 toward an upright position. When the key receiver 34 is pushed into an interior chamber of the key activated toy vehicle 20 by the force of a user, the contact end 66*a* of the upwardly extending arm 66 contacts the interior portion 36*a* of the moveable part 36 thereby causing the moveable part 36 to move from the first position (solid lines in FIG. 1) to the second position (phantom lines in FIG. 1).

The key activated toy vehicle 20 also includes a circuit 40 having a battery or batteries BT1, BT2, BT3 mounted within at least one of the body 22 and the chassis 24 and held in place by a battery compartment cover 21. Preferably, the batteries BT1, BT2, BT3 are mounted in the chassis 24. A light 42 is connected to the circuit 40 so as to be selectively illuminated. Preferably, the light 42 is mounted through a hole 19 in the top of the body 22 under a light bar or lens cap 38. Additionally, the key activated toy vehicle 20 includes a sound generator 44 electrically connected to the circuit 40 for generating sound such as sirens, horns, and the like. Preferably, the sound generator 44 is a conventional speaker. However, the sound generator 44 may be other known sound generating devices such Piezoelectric ceramic disks, electromechanical reeds and the like, without departing from the broad scope of the present invention. The circuit 40 further includes a contact switch 46 which is a normally-open, single-pole, dry-contact-type switch having a cam 46*a* on one of the contacts such that upon contact with either the plunger 26 or the key receiver 34, the switch is closed causing the circuit 40 to energize the light 42 and the sound generator 44. The switch 46 may be other known types of switches without departing from the broad inventive concept herein.

Preferably, the key activated toy vehicle 20 is used in combination with the key 50. The key 50 includes an elongate key member 52 having a first end 52*a* configured for receipt into the key receiver 34, a clasp member 54 moveably attached to the elongate key member to pivot on pin 57 between a locked position and a released position, and a spring 56 positioned to bias the clasp member 54 into the locked position. Preferably, the clasp member 54 includes a detent 55 suitable for engagement in a retaining slot 25 in the chassis 24 of the key activated toy vehicle 20. Preferably, the spring 56 is a torsion-type spring having first and second torsion arms 56*a,* 56*b*. The key 50 further includes a thumb switch or thumb rest 58 which is fixedly attached to an opposing end 54*b* of clasp member 54 that extends through a ring at a second end 52*b* of the key member 52.

The first end 52*a* of the elongate key member 52 is designed (sized and shaped) to be inserted into the key slot 35 and may have integrally molded markings similar to a key. The thumb rest 58 has the overall appearance of a badge, in the presently preferred embodiment the thumb rest 58 has the overall appearance of a fireman's badge. The thumb rest 58 may have the overall appearance of other badges and other devices without departing from the present invention. Preferably the elongate key member 52, the clasp member 54, and the thumb rest 58 are formed of a molded polymeric material. However, the elongate member 52, the clasp member 54, and the thumb rest 58 may be formed of other materials such as wood, metal and the like and by other processes such as machining, carving and the like without departing from the present invention.

In use, a user can press an exterior portion of the key receiver 34 into the key activated toy vehicle 20 causing the upwardly extending arm 66 to contact an interior portion of the moveable part 36 moving the moveable part 36 from the first position to the second position and also making contact with the cam 46*a* on the switch 46 closing the switch 46 and causing the light 42 to illuminate the light bar 38 and the sound generator 44 to generate a noise such as a siren or a horn. When the user removes pressure from the key receiver 34, the spring 32 biases the key receiver 34 toward the rear end 22*b* of the body 22 allowing the moveable part 36 to return from the second position to the first position and the circuit 40 turns off the light 42 and the sound generator 44 after a predetermined period of time. A user may also insert the elongate key member 52 of the key 50 into the key slot 35 against the biasing force of the spring 32 pushing the key receiver 34 and the plunger 26 inwardly. If the user releases pressure from the thumb rest 58, the detent 55 of the clasp member 54 engages the retaining slot 25 of the chassis 24. The key 50 is thereby retained in a locked position with the spring 32 fully compressed (loaded) ready to release pressure on the plunger 26 and the key receiver 34. The moveable part 36 is in the second position or in this case the ladder is extended vertically at an angle from the top of the body 22. When the user grasps a second end 52*b* of the elongate key member 52 and gently presses on the thumb rest 58, the clasp member 54 moves from the locked position to the released position against the biasing force of torsion spring 56. The detent 55 of the clasp member 54 moves out of the retaining slot 25 allowing the spring 32 to fully extend biasing the plunger 26 rapidly towards the rear of the vehicle imparting a propulsion force on the key activated toy vehicle 20 and allowing the key activated toy vehicle 20 to move in the forward direction. In the presently preferred embodiment, the spring 32 serves a dual role in biasing the key receiver 34 and the plunger 26 toward the rear end 22*b* of the body 22 and also as propulsion mechanism. It is contemplated that other more complicated propulsion mechanisms could be used in combination with the devices disclosed herein without departing from the present invention.

Figure 3:
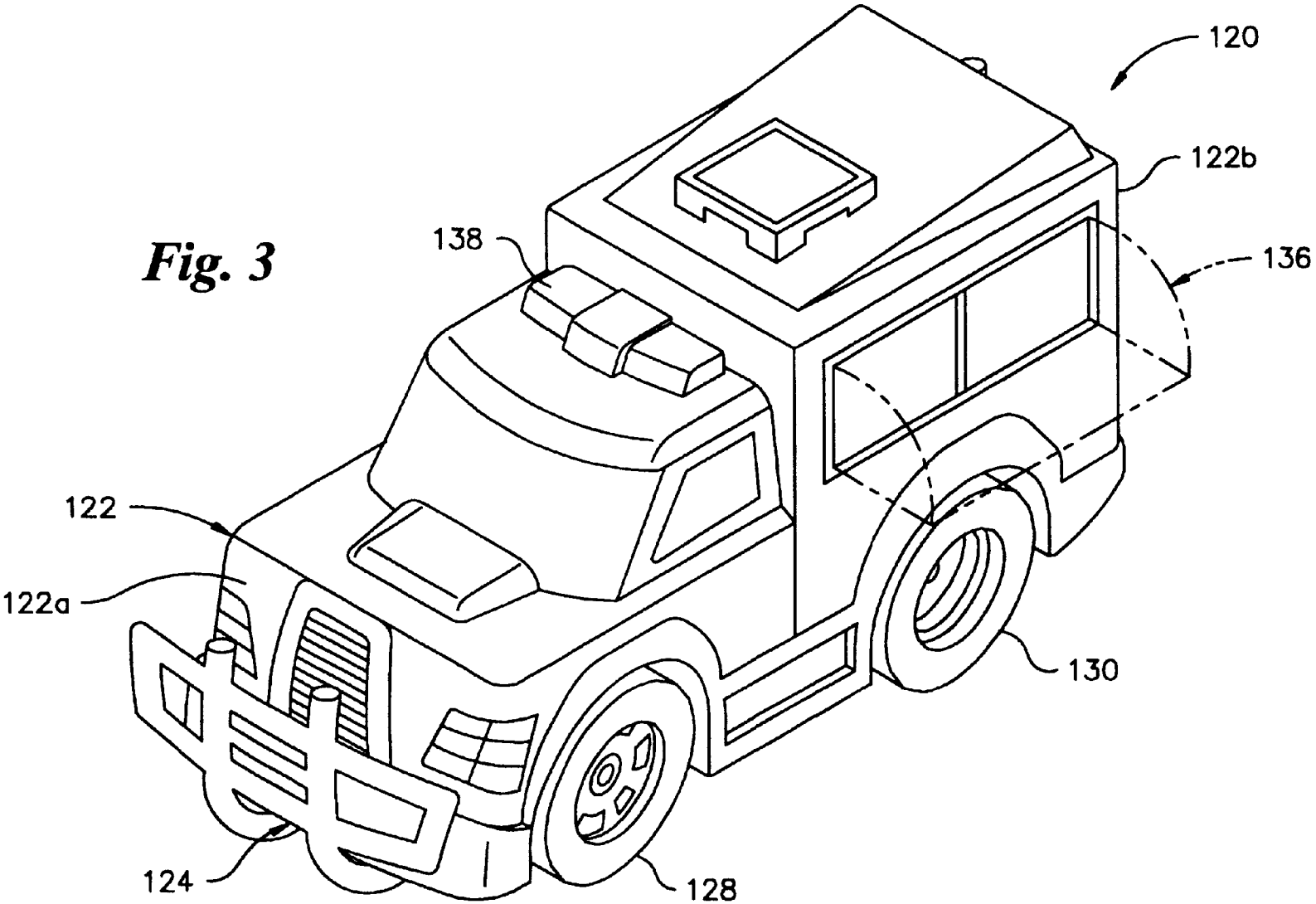
FIG. 3 is a perspective view of a key activated toy vehicle in accordance with a second preferred embodiment of the present invention.
Figure 4:
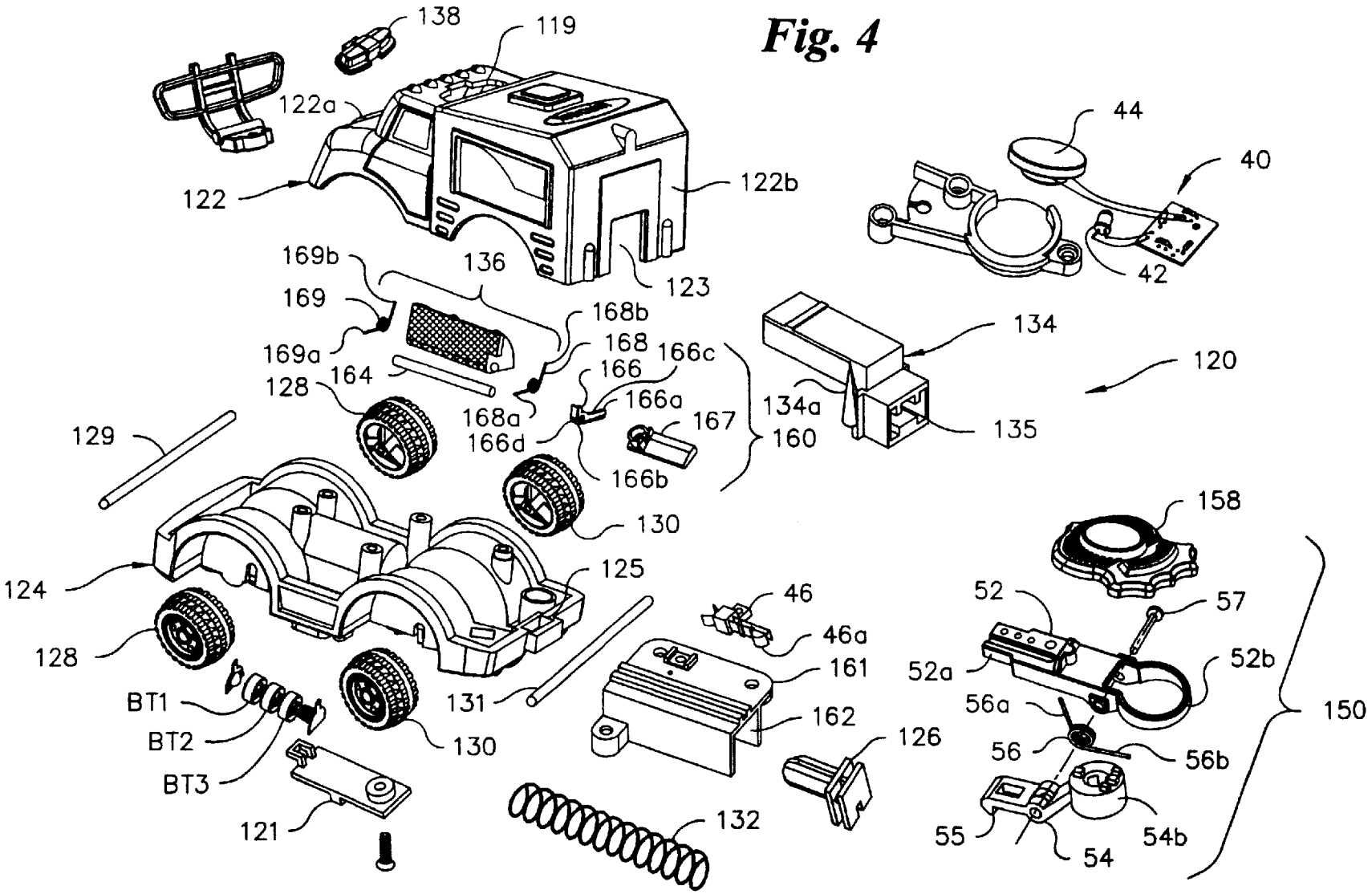
FIG. 4 is an exploded view of the toy vehicle of FIG. 3

FIGS. 3–4 show a key activated toy vehicle 120 in accordance with a second preferred embodiment of the present invention. The key activated toy vehicle 120 has the overall appearance of a K-9 wagon with a side door that opens to reveal K-9/dog figurines therein. The key activated toy vehicle 120 includes a body 122, a chassis 124 and a plunger 126 supported in one of the chassis 122 and the body 124. The body 122 has a front end 122*a* and a rear end 122*b*. The chassis 124 accommodates the body 122 and has at least a front wheel 128 proximate the front end 122*a* of the body 122 and a rear wheel 130 proximate the rear end 22*b* of the body 122. Preferably, the key activated toy vehicle 120 has two front wheels 128 and two rear wheels 130 moveably mounted on axles 129 and 131, respectively. At least one of the body 122 and the chassis 124 defines an opening 123 to an interior of the key activated toy vehicle 120. Preferably, the body 122 defines the opening 123. A spring 132 is supported within the key activated toy vehicle 120 so as to be compressed by a key 150 inserted through the opening 123 and to propel the toy vehicle 120 away from the key 150 upon decompressing. Preferably, the spring 132 is operably coupled with the plunger 126 and biases the plunger 126 toward the rear end 122*b* of the body 122. The key activated toy vehicle 120 also includes a moveable part 136 in the form of an opening side-door having a portion exterior to the body 122 and a portion interior to the body 122 and is supported on at least one of the chassis 124 and the body 122 for movement between a first position and a second position. The key activated toy vehicle 120 further includes an actuator mechanism 160 operably coupled with the spring 132 and moveably mounted within the vehicle so as to be coupled with the moveable part 136 to move the part 136 from the first position to the second position as the actuator mechanism 160 moves against the bias of the spring 132.

Referring to FIG. 4 in detail, the actuator mechanism 160 includes a key receiver 134 that is moveably mounted generally at one of either the front end 122*a* or the rear end 122*b* of the body 122. Preferably the key receiver 134 is mounted at the rear end 122*b* of the body 122 and extends at least partially through the opening 123. The key receiver 134 defines at least part of a key slot 135 and is biased rearwardly by the spring 132. The key receiver 134 rides on a base support 161 with an elongate channel guide 162 formed in the base support 161. The mechanism 160 also includes a pivot pin 164, an arm 166, a rotary cam 167 and first and second torsion springs 168, 169. The elongate channel guide 162 extends from an end 134*a* of the key receiver 134 and defines at least part of the key slot 135. The pivot pin 164 is moveably mounted within the actuator mechanism 160. The arm 166 has a contact end 166*a*, a pivot end 166*b*, a spring slot 166*c* and a pin hole 166*d* to receive the pivot pin 164 at the pivot end 166*b*. The first torsion spring 168 has a first end 168*a* in the spring slot 166*c* of the arm 166 and a second end 168*b* resting on an interior channel of the moveable part 136. The second torsion spring 169 has a first end 169*a* resting on an interior surface of the body 122 and a second end 169*b* resting on another interior channel of the moveable part 136. The first and second torsion springs 168, 169 bias the arm 166 and the moveable part 136 toward the first position where the door appears closed (solid lines in FIG. 3). When the key receiver 134 is pushed into an interior chamber of the key activated toy vehicle 120 by the force of a user, the rotary cam 167 moves the arm 166 and the contact end 166*a* of the arm 166 contacts the interior portion of the moveable part 136 thereby causing the moveable part 136 to move from the first position (solid lines in FIG. 3) to the second position (phantom lines in FIG. 3) against the bias of the first and second torsion springs 168, 169.

The key activated toy vehicle 120 also includes the circuit 40 identical to the circuit 40 described above. The circuit 40 has the battery or batteries BT1, BT2, BT3 mounted within at least one of the body 122 and the chassis 124 and held in place by a battery compartment cover 121. Preferably, the batteries BT1, BT2, BT3 are mounted in the chassis 124. Preferably, the light 42 is mounted through a hole 119 in the top of the body 122 under a light bar or lens cap 138. The cam 46*a* on one of the contacts of the switch 46 for engagement with either the plunger 126 or the key receiver 134 to close the switch 46 and causing the circuit 40 to energize the light 42 and the sound generator 44.

Preferably, the key activated toy vehicle 120 is used in combination with the key 150. The key 150 includes the elongate key member 52 configured for receipt into the key receiver 134, the clasp member 54 moveably attached to the elongate key member 52 to pivot on pin 57 between a locked position and a released position, and the torsion spring 56 positioned to bias the clasp member into the locked position. Preferably, the clasp member 54 includes the detent 55 suitable for engagement in a retaining slot 125 in the chassis 124 of the key activated toy vehicle 120. The key 150 further includes a thumb switch or thumb rest 158 fixedly attached to an opposing end 54*b* of clasp member 54 that extends through a ring at the second end 52*b* of the key member 52.

In use, a user can press an exterior portion of the key receiver 134 into the key activated toy vehicle causing the rotary cam 167 to move the arm 166 and the arm 166 to contact the interior portion of the moveable part 136 moving the moveable part 136 from the first position to the second position and also closing or making contact with the cam 46*a* of the switch 46 closing the switch 46 thereby causing the light 42 to illuminate the light bar 138 and the sound generator 44 to generate a noise such as a siren or a horn. When the user removes pressure from the key receiver 134, the spring 132 biases the key receiver 134 toward the rear end 122*b* of the body 122 and allowing the moveable part 136 to return from the second position to the first position and the circuit 40 turns off the light 42 and the sound generator 44 after a predetermined period of time. A user may also insert the elongate key member 52 of the key 150 into the key slot 135 against the biasing force of the spring 132 pushing the key receiver 134 and the plunger 126 inwardly. If the user releases pressure from the thumb rest 158, the detent 55 of the clasp member 54 engages the retaining slot 125 of the chassis 124. The key 150 is thereby retained in a locked position with the spring 132 fully compressed (loaded) ready to release pressure on the plunger 126 and the key receiver 134. The moveable part 136 is in the second position or in this case the door is rotated open exposing the K-9/dog figurines from within the interior of the body 122. When the user grasps the second end 52*b* of the elongate key member 52 and gently press on the thumb rest 158, the clasp member 54 moves from the locked position to the released position against the biasing force of the torsion spring 56. The detent 55 of the clasp member 54 moves out of the retaining slot 125 allowing the spring 132 to fully extend biasing the plunger 126 rapidly towards the rear of the key activated toy vehicle 120 imparting a propulsion force on the key activated toy vehicle 120 and allowing the key activated toy vehicle 120 to move in the forward direction. Similar to the first preferred embodiment, the spring 132 serves a dual role in biasing the key receiver 134 and the plunger 126 toward the rear end 122*b* of the body 122 and also as a propulsion mechanism.

Figure 5:
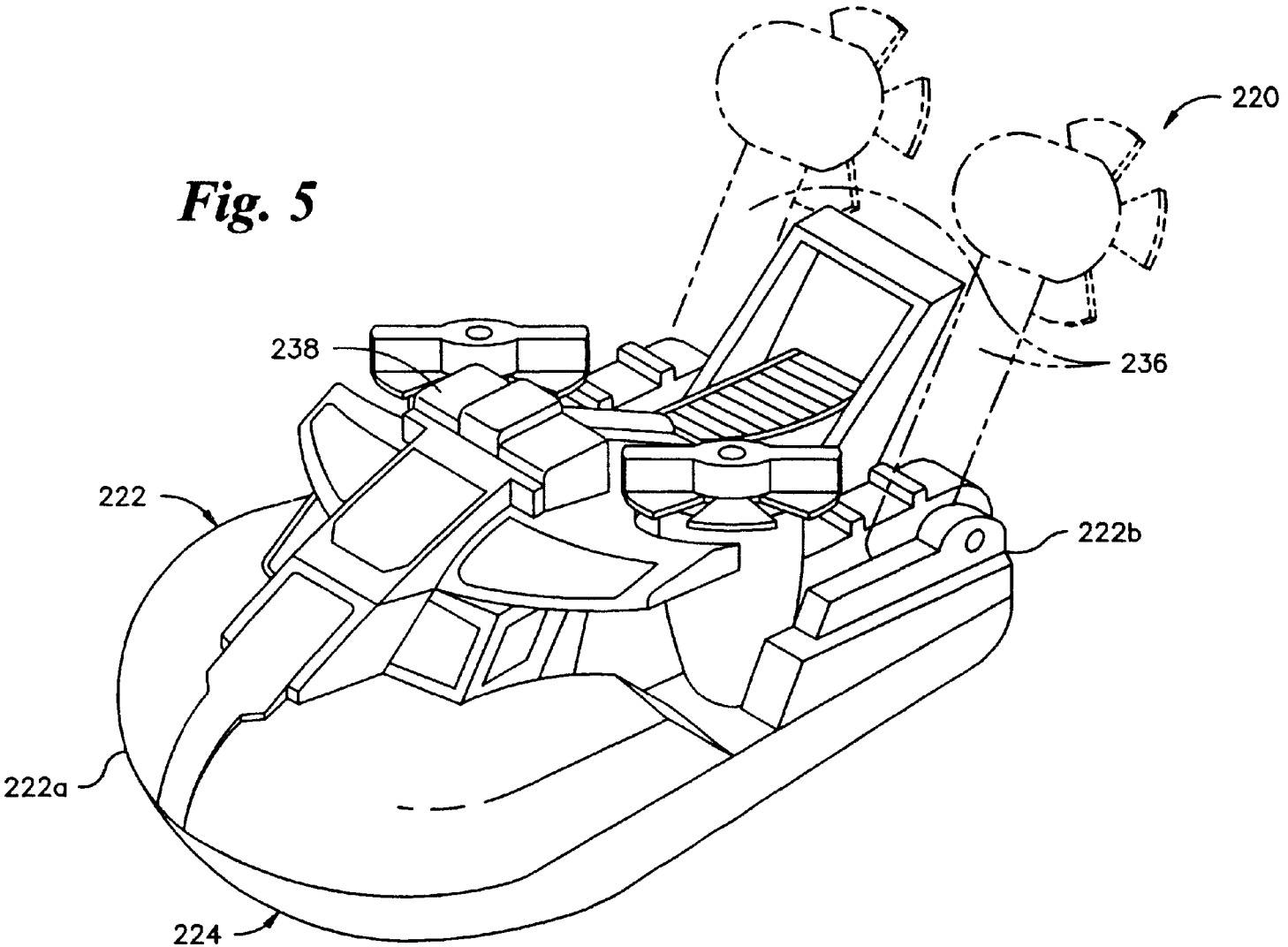
FIG. 5 is a perspective view of a key activated toy vehicle in accordance with a third preferred embodiment of the present invention.
Figure 6:
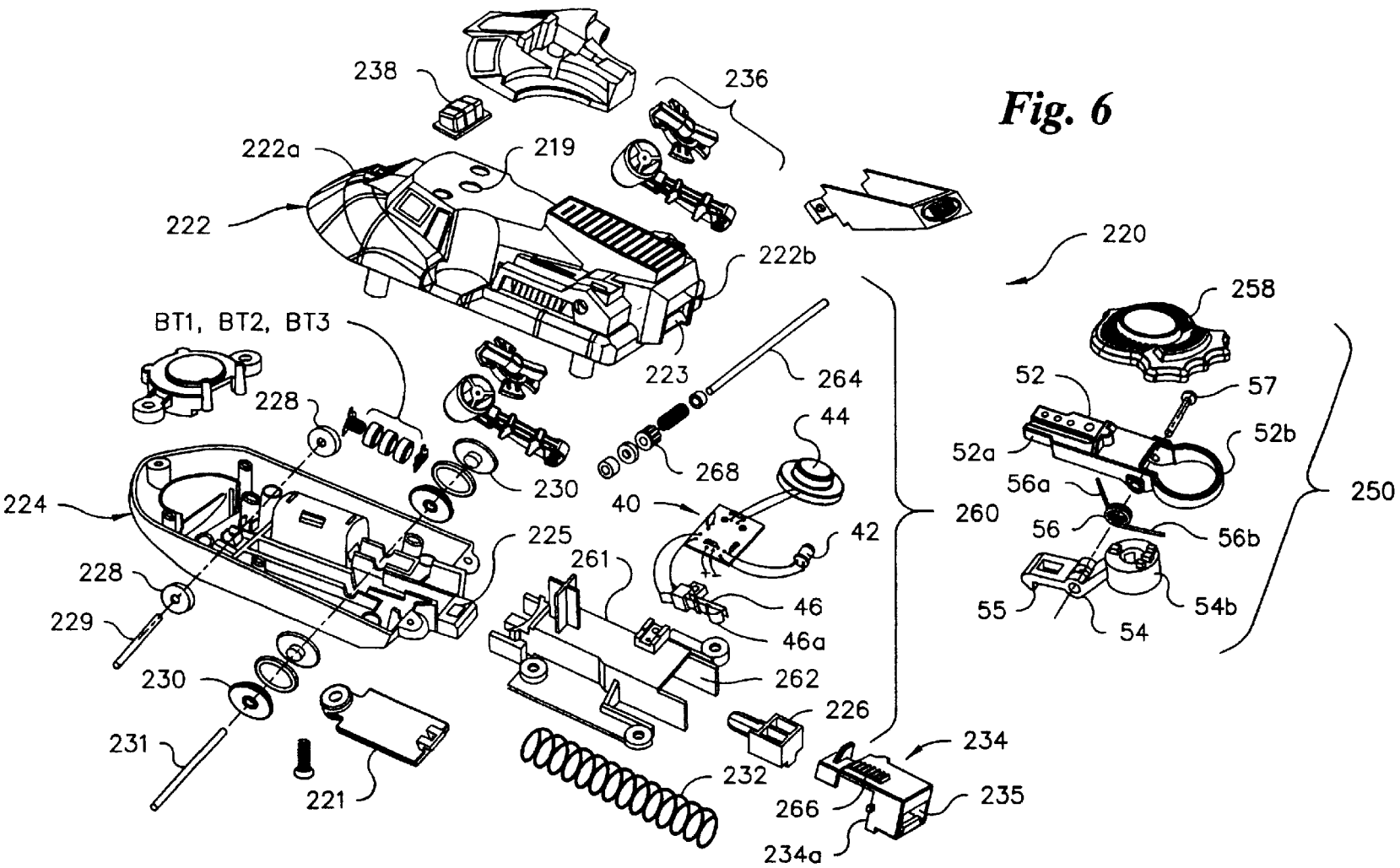
FIG. 6 is an exploded view of the toy vehicle of FIG. 5

FIGS. 5–6 show a key activated toy vehicle 220 in accordance with a third preferred embodiment of the present invention. The key activated toy vehicle 220 has the overall appearance of a rescue hovercraft with propellers that raise. The key activated toy vehicle 220 includes a body 222, a chassis 224 and a plunger 226 supported in one of the chassis 222 and the body 224. The body 222 has a front end 222*a* and a rear end 222*b*. The chassis 224 accommodates the body 222 and has at least a front wheel 228 proximate the front end 222*a* of the body 222 and a rear wheel 230 proximate the rear end 222*b* of the body 222. Preferably, the key activated toy vehicle 220 has two front wheels 228 and two rear wheels 230 moveably mounted on axles 229 and 231, respectively. At least one of the body 222 and the chassis 224 defines an opening 223. Preferably, both the body 222 and the chassis 224 together define the opening 223. A spring 232 is supported within the key activated toy vehicle 220 so as to be compressed by a key 250 inserted through the opening 223 and to propel the toy vehicle 220 away from the key 250 upon decompressing. Preferably, the spring 232 biases the plunger 226 toward the rear end 222*b* of the body 222. The key activated toy vehicle also includes a moveable part 236 in the form of rotatable, moveable propellers supported on at least one of the chassis 224 and the body 222, in this case the body 222, for movement between a first position and a second position. The key activated toy vehicle 220 further includes an actuator mechanism 260 operably coupled with the spring 232 and moveably mounted within the vehicle so as to be coupled with the moveable part 236 to move the part 236 from the first position to the second position as the actuator mechanism 260 moves against the bias of the spring 232.

Referring to FIG. 6 in detail, the actuator mechanism 260 includes a key receiver 234 that is moveably mounted generally at one of either the front end 222*a* or the rear end 222*b* of the body 222. Preferably, the key receiver 234 is mounted in the body 222 and extends at least partially through the opening 223. The key receiver 234 defines at least part of a key slot 235 and is biased rearwardly by the spring 232. The key receiver 234 rides on a base support 261 with an elongate channel guide 262. The mechanism 260 also includes a pivot pin 264, a row of teeth 266 disposed on a portion of the key receiver 234, and a translation gear 268. The elongate channel guide 262 extends from an end 234*a* of the key receiver 234 and defines at least part of the key slot 235. The pivot pin 264 is moveably mounted partially within the moveable part 236, the body 222, the chassis 224 and the base support 262 of the actuator mechanism 260. When the key receiver 234 is pushed into an interior chamber of the key activated toy vehicle 220 by the force of a user, the row of teeth 266, in mesh with the translation gear 268, rotates the translation gear 268 which is coupled to the pivot pin 264, also causing the pivot pin 264 to rotate. The pivot pin 264 is coupled to the moveable part 236 thereby causing the moveable part 236 to move from the first position (solid lines in FIG. 5) to the second position (phantom lines in FIG. 5). In the presently preferred embodiment, the moveable part 236 is mounted entirely on the outside of the body 222 of the key activated toy vehicle 220, but appropriate contours and fittings are formed in the body 222 to allow the moveable part to partially rotate and to be stored in an almost flush storage position (the first position).

The key activated toy vehicle 220 also includes the circuit 40 identical to the circuit 40 described above for the other embodiments. The circuit 40 has the battery or batteries BT1, BT2, BT3 mounted within at least one of the body 222 and the chassis 224 and held in place by a battery compartment cover 221. Preferably, the batteries BT1, BT2, BT3 are mounted in the chassis 224. Preferably, the light 42 is mounted through a hole 219 in the top of the body 222 under a light bar or lens cap 238. The cam 46*a* on one of the contacts of the switch 46 engages either the plunger 226 or the key receiver 234 to close the switch 46 and cause the circuit 40 to energize the light 42 and the sound generator 44.

Preferably, the key activated toy vehicle 220 is used in combination with the key 250. The key 250 includes the elongate key member 52 configured for receipt into the key receiver 234, the clasp member 54 moveably attached to the elongate key member 52 to pivot on pin 57 between a locked position and a released position, and the torsion spring 56 positioned to bias the clasp member 54 into the locked position, similar to the other keys 50, 150 described above. The key 250 further includes a thumb switch or thumb rest 258 which is fixedly attached to an opposing end 54*b* of clasp member 54 that extends through a ring at a second end 52*b* of the key member 52. Preferably, the clasp member 54 includes the detent 55 suitable for engagement in a retaining slot 225 in the chassis 224 of the key activated toy vehicle 220. The first end 52*a* of the elongate key member 252 is designed to be inserted into the key slot 235. The thumb rest 258 of the presently preferred embodiment has the overall appearance of a patrol or harbor patrol badge. The thumb rest 258 may have the overall appearance of other badges and other devices without departing from the present invention.

In use, a user can press an exterior portion of the key receiver 234 into the key activated toy vehicle 220 causing the row of teeth 266 to rotate the translation gear 268 and the pivot pin 264 thereby moving the moveable part 236 from the first position to the second position and also making contact with the cam 46*a* of the switch 46 closing the switch and causing the light 42 to illuminate the light bar 238 and the sound generator 44 to generate a noise such as a siren or a horn. When the user removes pressure from the key receiver 234, the spring 232 biases the key receiver toward the rear end 222*b* of the body 222 and allows the moveable part 236 to return from the second position to the first position and the circuit 40 turns off the light 42 and the sound generator 44 after a predetermined period of time. A user may also insert the elongate key member 52 of the key 250 into the key slot 235 against the biasing force of the spring 232 pushing the key receiver 234 and the plunger 226 inwardly. If the user releases pressure from the thumb rest 258, the detent 55 of the clasp member 54 engages the retaining slot 225 of the chassis 224. The key 250 is thereby retained in a locked position with the spring 232 fully compressed (loaded) ready to release pressure on the plunger 226 and the key receiver 234. The moveable part 236 is in the second position or in this case the propellers are vertically extended from the top of the body 222 at some predetermined angle. When the user grasps the second end 52*b* of the elongate key member 52 and gently presses on the thumb rest 258, the clasp member 54 moves from the locked position to the released position against the biasing force of the torsion spring 56. The detent 55 of the clasp member 54 moves out of the retaining slot 225 allowing the spring 232 to fully extend biasing the plunger 226 rapidly towards the rear of the key activated toy vehicle 220 imparting a propulsion force on the toy vehicle 220 and allowing the key activated toy vehicle 220 to move in the forward direction. In the presently preferred embodiment, the spring 232 serves a dual role in biasing the key receiver 234 and the plunger 226 toward the rear end 222*b* of the body 222 and also as a propulsion mechanism.

Figure 7A:
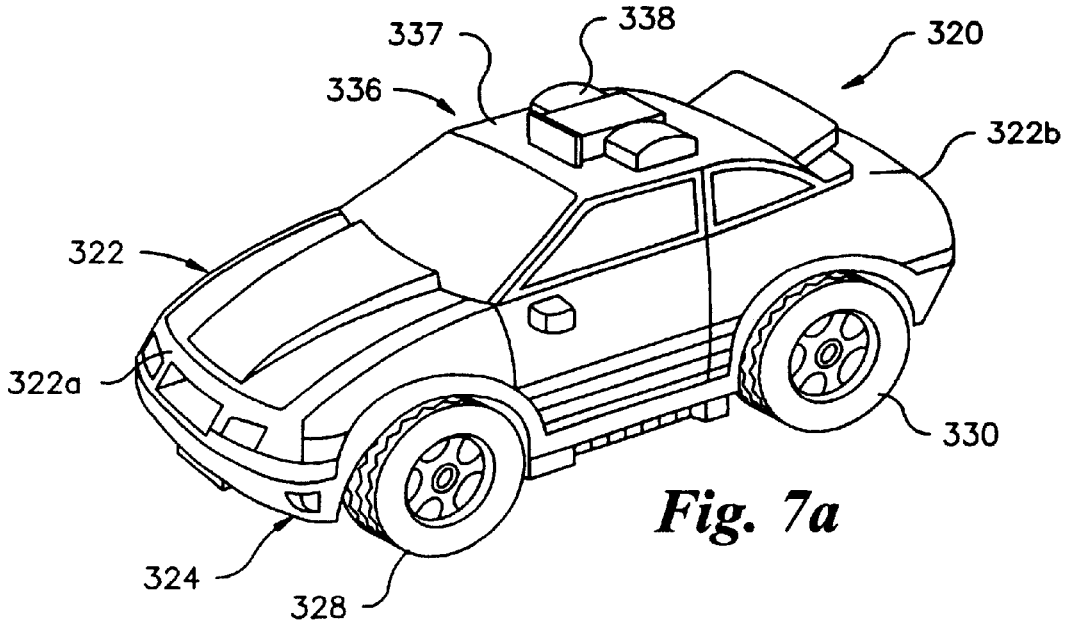
FIG. 7*a* is a perspective view of a key activated toy vehicle in accordance with a fourth preferred embodiment of the present invention with a moveable part in a first position.
Figure 7B:
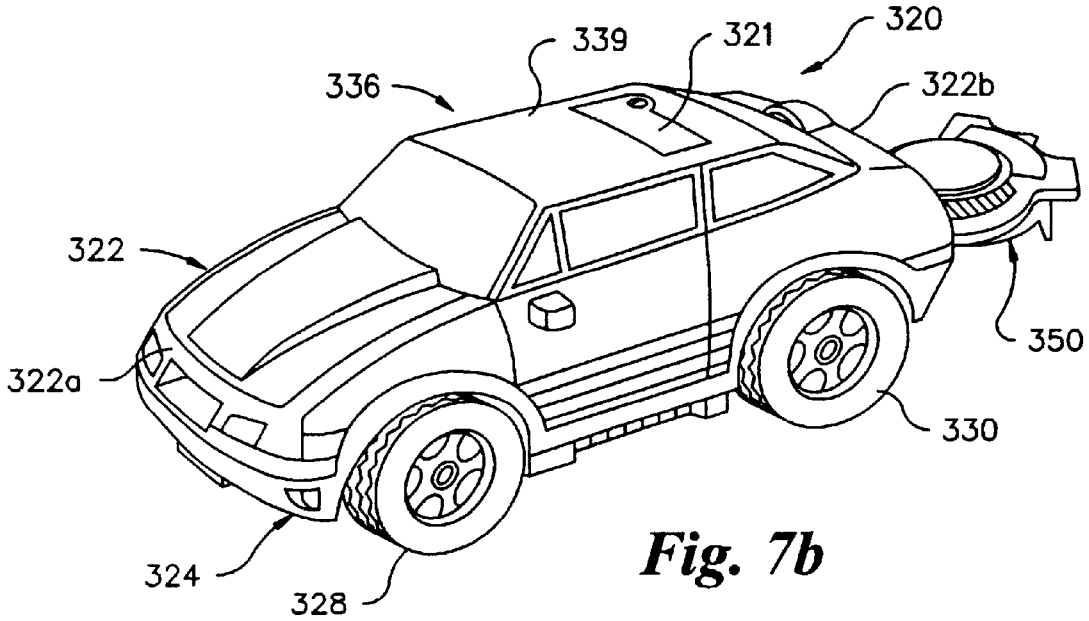
FIG. 7*b* is a perspective view of the key activated toy vehicle of FIG. 7A with the moveable part in a second position.
Figure 8:
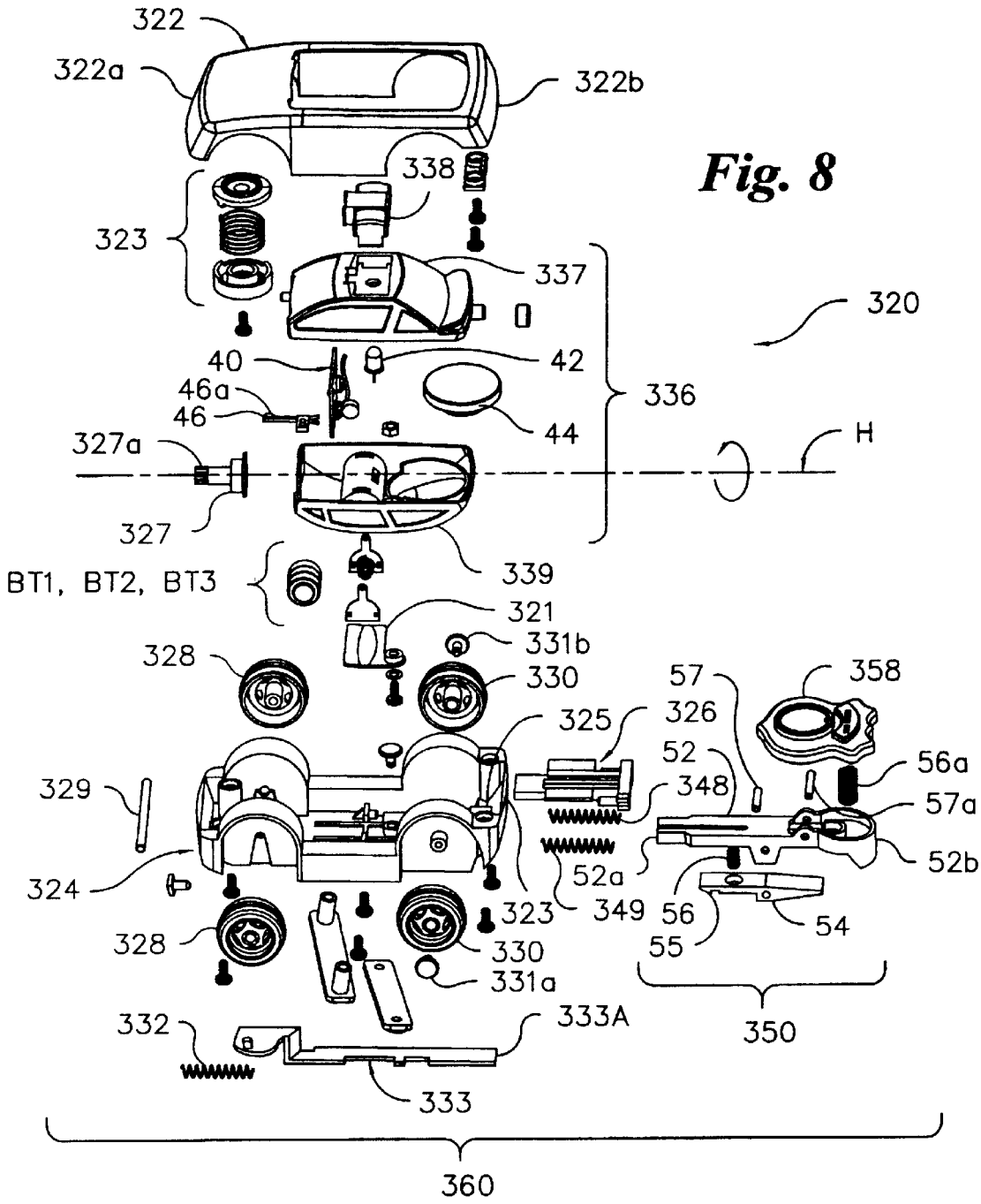
FIG. 8 is an exploded view of the toy vehicle of FIG. 7.

Referring to FIGS. 7*a*–7*b* and 8 there is shown a key activated toy vehicle 320 in accordance with a fourth preferred embodiment of the present invention. The key activated toy vehicle 320 has the overall appearance of either a police cruiser (FIG. 7*a*) or an undercover police car (FIG. 7*b*). The key activated toy vehicle 320 has a body 322, a chassis 324, and a plunger 326. The body 322 has a front end 322*a* and a rear end 322*b*. The chassis 324 accommodates the body 322 and has at least a front wheel 328 at the front end 322*a* of the body 322 and rear wheel 330 at the rear end 322*b* of the body 322. Preferably, the toy vehicle 320 has two front wheels 328 moveably mounted on a front axle 329 and two rear wheels 330 moveably mounted on two rear axles 331*a*, 331*b*. At least one of the body 322 and the chassis 324 defines an opening 323 to an interior of the key activated toy vehicle 320. Preferably, the chassis 324 defines the opening 323. At least a first spring 332 is supported within the key activated toy vehicle 320 so as to be compressed by a key 350 inserted through the opening 323 and to propel the toy vehicle 320 away from the key upon decompressing. Preferably, the key activated vehicle includes three springs 332, 348, 349. Preferably, one or more of the springs 332, 348, 349 are operably coupled with the plunger 326 and bias the plunger 326 toward the rear end 322*b* of the body 322. The key activated toy vehicle 320 also includes a moveable part 336 in the form of rotatable cab portion supported on at least one of the chassis 324 and the body 322 for movement between a first position and a second position. In the presently preferred embodiment, the moveable part 336 is mounted to the body 322 to pivot about a horizontal axis H (dashed line in FIG. 8). Preferably, the moveable part 336 has a first surface 337 and a second surface 339 each having sufficiently different features, to differentiate the first and second surfaces. The key activated toy vehicle 320 further includes an actuator mechanism 360 operably coupled with the first spring 332 and moveably mounted within the vehicle so as to be coupled with the moveable part 336 to move the part 336 from the first position to the second position as the actuator mechanism 360 moves against the bias of the first spring 332.

Referring to FIG. 8 in detail, the actuator mechanism 360 includes a crown gear 327 connected to the moveable part 336 proximate a location along the horizontal axis H. The crown gear 327 is fixed to the moveable part 336 by known means and preferably has gear teeth 327*a* on an end extending away from the moveable part 336. A drive gear 323 is in engagement with the crown gear 327. The actuator mechanism 360 also includes a lever 333 moveably coupled with the drive gear 323, the first spring 332 is positioned to bias the lever 333 toward the rear end 322*b* of the body 322. Preferably, an end 333A of the lever 333 extends out of a second opening 323 defined by the chassis 324 to allow the lever 333 to be pushed from outside the toy vehicle 320.

The moveable part 336 is also moved from the first position displaying the first surface 337 to the second position displaying the second surface 339 against the biasing force of the springs 332, 348, 349 in response to movement of the plunger 326. Preferably, the plunger 326 is also accessible through the opening 323 to allow movement by the key 350 when the key 350 is inserted into the opening 323. Due to the length of the lever 333 and the weight of the moveable part 336, the second and third biasing springs 348, 349 are provided in addition to the first spring 332 to return the key receiver 334 and the lever 333 to a position toward the rear end 322*b* of the body 322 with sufficient force to propel the key activated toy vehicle 320 and to turn the moveable part 336 back from the second position to the first position. Obviously any number of springs could be utilized without departing from the broad inventive scope of the present invention.

The key activated toy vehicle 320 also includes the circuit 40 identical to the circuit 40 described above for the other embodiments; however, the circuit 40 is preferably mounted within the moveable part 336 in the presently preferred embodiment. The circuit 40 has the battery or batteries BT1, BT2, BT3 mounted within at least one of the moveable part 336, the body 322 and the chassis 324 and held in place by a battery compartment cover 321. Preferably, the batteries BT1, BT2, BT3 are mounted in the moveable part 336. Preferably, the light 42 is mounted through a hole 319 in the first surface 337 of the moveable part 336 under a light bar or lens cap 338. The cam 46*a* on one of the contacts of the switch 46 engages a protrusion on the crown gear 327 to close the switch 46 and cause the circuit 40 to energize the light 42 and the sound generator 44.

Preferably, the key activated toy vehicle 320 is used in combination with the key 350. The key 350 includes the elongate key member 52 configured for receipt into the key receiver 334, the clasp member 54 moveably attached to the elongate key member 52 to pivot between a locked position and a released position, and the torsion spring 56 positioned to bias the clasp member 54 into the locked position, similar to the other keys 50, 150, 250 described above. The clasp member 52 is pivotally attached to the elongate key member by the pivot pin 57. The key 350 further includes a thumb switch or thumb rest 358 pivotally attached to the elongate key member 52 by another pivot pin 57*a* and is biased by a second torsion spring 56*a*. Preferably, the clasp member 54 includes the detent 55 suitable for engagement in a retaining slot 325 in the chassis 324 of the key activated toy vehicle 320. The first end 52*a* of the elongate key member 52 is designed to be inserted into the key slot 335. The thumb rest 358 of the presently preferred embodiment has the overall appearance of a policeman's badge. The thumb rest 358 may have the overall appearance of other badges and other devices without departing from the present invention.

In use, a user can press an exterior portion 333A of the lever 333 into the key activated toy vehicle 320 causing the lever 333 to turn the drive gear 323 thereby rotating the crown gear 327. The moveable part 336 is moved from the first position displaying the first surface 337 to the second position displaying the second surface 339 against the biasing force of the first spring 332. The crown gear 327 also makes contact with the cam 46*a* of the switch 46 closing the switch 46 and causing the light 42 to illuminate the light bar 338 and the sound generator 44 to generate a noise such as a siren or a horn. When the user removes pressure from the exterior portion 333A of the lever 333, the first spring 332 biases the lever 333 toward the rear end 322*b* of the body 322 and allows the moveable part 336 to return from the second position displaying the second surface 339 to the first position displaying the first surface 337 and the circuit 40 turns off the light 42 and the sound generator 44 after a predetermined period of time. A user may also insert the elongate key member 52 of the key 350 into the key slot 335 against the biasing force of the first, second and third springs 332, 348, 349 pushing the key receiver 334, the plunger 326, and the lever 333 inwardly. If the user releases pressure from the thumb rest 358, the detent 55 of the clasp member 54 engages the retaining slot 325 of the chassis 324. The key 350 is thereby retained in a locked position with the first, second and third springs 332, 348, 349 fully compressed (loaded) ready to release pressure on the plunger 326, the lever 333 and the key receiver 334. The moveable part 336 is in the second position or in this case the second surface 339 is displayed from the top of the body 322. When the user grasps the second end 52*b* of the elongate key member 52 and gently presses on the thumb rest 358, the clasp member 54 moves from the locked position to the released position against the biasing force of torsion spring 56. The detent 55 of the clasp member 54 moves out of the retaining slot 325 allowing the first, second and third springs 332, 348, 349 to fully extend biasing the plunger 326 rapidly towards the rear of the key activated toy vehicle 320 imparting a propulsion force on the key activated toy vehicle 320 and allowing the key activated toy vehicle 320 to move in the forward direction. In the presently preferred embodiment, the first, second and third springs 332, 348, 349 serve a dual role in biasing the key receiver 334, the lever 333 and the plunger 226 toward the rear end 322*b* of the body 322 and also as a propulsion mechanism.

From the foregoing, it can be seen that the present invention comprises a key activated toy vehicle including a vehicle or moveable part in or on either the chassis or the body wherein the vehicle or moveable part is moved by mechanical power from a key receiver, a lever or plunger that is spring biased to also propels the key activated toy vehicle. It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A key activated toy vehicle propelled utilizing a key, the toy vehicle comprising:

a body having a front end, a rear end and an exterior;

a chassis that accommodates the body and has at least a front wheel proximate the front end and a rear wheel proximate the rear end, at least one of the body and the chassis defining an opening to an interior of the toy vehicle;

a spring supported within the interior of the toy vehicle so as to be compressed by a key inserted through the opening and to propel the toy vehicle away from the key upon decompressing;

a moveable part having at least a portion on the exterior of the body and being supported on at least one of the chassis and the body for movement between a first position and a second position; and an actuator mechanism operably coupled with the spring and moveably mounted within the vehicle so as to be coupled with the moveable part to move the part from the first position to the second position as the actuator mechanism moves against the bias of the spring.

2. The key activated toy vehicle according to claim 1 wherein the moveable part has a first surface visible on the vehicle in at least the first position of the part and a second surface visible on the vehicle only in the second position of the part, each surface having sufficiently different features to differentiate the first and second surfaces, the moveable part being mounted to pivot about a horizontal axis.

3. The key activated toy vehicle according to claim 2 wherein the actuator mechanism comprises:

a crown gear connected to the moveable part proximate a location along the horizontal axis;

a drive gear in engagement with the crown gear; and a lever moveably coupled with the drive gear and being biased rearwardly by the spring, whereby the moveable part is moved from the first position displaying the first surface to the second position displaying the second surface in response to movement of the lever against the biasing force of the spring.

4. The key activated toy vehicle according to claim 1 wherein the actuator mechanism further comprises a key receiver moveably mounted generally at the rear end of the body proximal the opening, the key receiver defining at least part of a key slot and being biased rearwardly by the spring.

5. The key activated toy vehicle according to claim 4 in combination with the key, wherein the key comprises an elongate key member configured for extension through the opening and receipt in the key receiver, a clasp member moveably coupled with the elongate key member to pivot between a locked position and a release position, and a spring positioned to bias the clasp member into the locked position.

6. The key activated toy vehicle according to claim 5 wherein the key further comprises a badge connected to the clasp member that serves as a thumb switch for a user.

7. The key activated toy vehicle according to claim 4 wherein the actuator mechanism further comprises:

an arm extending upwardly from the key receiver having an upper, contact end and a lower, pivot end; and a spring operably positioned to bias the upper end of the arm toward an upright position such that when a key receiver is pushed into an interior chamber of the vehicle by the force of a user, the contact end of the upwardly extending arm contacts the interior portion of the moveable part so as to cause the moveable part to move from the first position to the second position.

8. The key activated toy vehicle according to claim 4 wherein the actuator mechanism further comprises:

an arm having a contact end and a pivot end;

a rotary cam in moveable engagement with the arm; and a spring operably positioned to bias the arm toward an upright position such that when the key receiver is pushed into an interior chamber of the vehicle by the force of a user, the rotary cam moves the arm and the contact end of the arm contacts the interior portion of the moveable part so as to cause the moveable part to move from the first position to the second position.

9. The key activated toy vehicle according to claim 4 wherein the actuator mechanism further comprises:

a pivot pin moveably mounted in the interior and operably connected to the moveable part;

a row of teeth disposed on a portion of the key receiver; and a translation gear coupled to the pivot pin and in mesh with the row of teeth such that when the key receiver is pushed into an interior chamber of the vehicle by the force of a user, the row of teeth rotates the translation gear causing the pivot pin to rotate so as to cause the moveable part to move from the first position to the second position.

10. The key activated toy vehicle according to claim 1 further comprising a circuit having a battery mounted within at least one of the body and the chassis.

11. The key activated toy vehicle according to claim 10 wherein the key activated toy further includes a sound generator electrically connected to the circuit.

12. The key activated toy vehicle according to claim 10 wherein the key activated toy further includes a light electrically connected to the circuit.

13. The key activated toy vehicle according to claim 1 further comprising a plunger moveably supported in one of the chassis and the body and being biased either rearwardly or forwardly by the spring, wherein the plunger imparts a propulsion force on the key activated toy vehicle from decompressing of the spring.

14. The key activated toy vehicle according to claim 1 wherein the moveable part is one of a folding extension ladder, a door, a window, a tow boom, a boom light, a propeller, a vehicle cab, a trunk lid, a water cannon and a fan.

15. The key activated toy vehicle according to claim 1 wherein the body is one of a police car, a fire rig, a fire truck, a tow truck, a sport utility vehicle, an off-road vehicle, a search-light vehicle, an ambulance, a helicopter, a boat, and a hovercraft.

* * * * *